US010883297B1

(12) United States Patent
Seise

(10) Patent No.: US 10,883,297 B1
(45) Date of Patent: Jan. 5, 2021

(54) DOORSTOP

(71) Applicant: Kenneth L. Seise, Ballwin, MO (US)

(72) Inventor: Kenneth L. Seise, Ballwin, MO (US)

( * ) Notice: Subject to any disclaimer, the term of this patent is extended or adjusted under 35 U.S.C. 154(b) by 0 days.

(21) Appl. No.: 16/587,182

(22) Filed: Sep. 30, 2019

(51) Int. Cl.
*E05F 5/02* (2006.01)
*E05F 5/06* (2006.01)

(52) U.S. Cl.
CPC ..... *E05F 5/06* (2013.01)

(58) Field of Classification Search
CPC ..... Y10T 16/61; Y10T 16/625; Y10T 16/628; E05C 17/16; E05C 17/52; E05C 17/54; E05C 17/60; E05C 17/64; E05C 17/443; E05C 19/188; E05F 5/00; E05F 5/02; E05F 5/06; E05Y 220/222; E05Y 220/224; E05Y 2900/132; F16M 13/002
See application file for complete search history.

(56) References Cited

U.S. PATENT DOCUMENTS 3,706,112 A * 12/1972 Newell ..... E05C 17/54 16/82
4,831,688 A 5/1989 Deininger
4,878,267 A 11/1989 Roach et al.
5,044,681 A * 9/1991 Neighbors ..... E05C 17/025 292/288
5,450,652 A * 9/1995 Webb ..... E05C 17/025 16/82
5,509,235 A 4/1996 Chander
5,511,837 A 4/1996 Dempsey et al.
5,680,675 A * 10/1997 Davis ..... E05C 17/025 16/83
5,692,264 A * 12/1997 van der Steur ..... B05B 13/0292 16/374
5,711,557 A 1/1998 Nicolosi
5,711,560 A * 1/1998 Gilbertson ..... E05C 17/54 292/343
6,616,128 B2 9/2003 Selzer
7,374,213 B2 5/2008 Carlson
7,506,905 B1 3/2009 George
7,559,114 B2 * 7/2009 Ranilovich ..... E05C 17/025 16/374
D603,694 S 11/2009 Bushey
(Continued)

FOREIGN PATENT DOCUMENTS

GB 2432629 A * 5/2007 ..... E05C 17/54
GB 2452146 A * 2/2009 ..... E05F 5/04

*Primary Examiner* — Chuck Y Mah
(74) *Attorney, Agent, or Firm* — Creativenture Law, LLC; Kevin C. Staed; Dennis J M Donahue, III

(57) ABSTRACT

The invention described herein is a wedge doorstop having a pair of adjacent sidewalls that respectively abut an edge of a door and a doorframe in a preferred orientation. Additionally, another sidewall of the stop abuts the frame stop of the doorframe and a compressible material along each one of the sidewalls protects the frame and increases friction. In operation, the door is opened and the doorstop is inserted into the gap between the frame and the door, and when the door begins to swing towards the frame, the wedge is sandwiched between the edge of the door and the frame. Additionally the compressive material prevents the doorstop from damaging the door or frame. Alternatively, the wedge can be inserted between the ground and bottom edge of the door.

20 Claims, 6 Drawing Sheets

(56) References Cited

U.S. PATENT DOCUMENTS

| | | | | |
|---|---|---|---|---|
| 7,690,080 | B1 * | 4/2010 | Coffman, II | E05C 17/54 16/82 |
| 7,904,992 | B2 | 3/2011 | Agster et al. | |
| 8,458,958 | B2 * | 6/2013 | Cress | E05F 5/04 49/462 |
| 8,863,561 | B2 | 10/2014 | Orlov et al. | |
| 9,097,044 | B2 * | 8/2015 | Mayer | E05C 17/54 |
| 9,127,489 | B2 * | 9/2015 | Orlov | E05C 17/025 |
| 10,760,309 | B1 * | 9/2020 | Bowman | E05C 17/54 |
| 2006/0208920 | A1 * | 9/2006 | Carrella | E05B 17/10 340/686.1 |
| 2007/0126248 | A1 | 6/2007 | Mintz | |
| 2008/0079270 | A1 * | 4/2008 | Carlson | E05C 17/025 292/343 |
| 2008/0277949 | A1 | 11/2008 | Emde et al. | |
| 2009/0260182 | A1 * | 10/2009 | Hall | E05C 17/025 16/82 |
| 2010/0242226 | A1 * | 9/2010 | Hopkins | E05C 17/54 16/82 |
| 2011/0254293 | A1 * | 10/2011 | Duff | E05C 17/025 292/343 |

* cited by examiner

DOORSTOP

CROSS-REFERENCE TO RELATED APPLICATIONS

This application claims priority from U.S. Provisional Patent Application No. 67/739,526 filed on Oct. 1, 2018.

STATEMENT REGARDING FEDERALLY SPONSORED RESEARCH

Not Applicable.

APPENDIX

Not Applicable.

BACKGROUND OF THE INVENTION

Field of the Invention

The present invention relates to doorstops, and more particularly to portable doorstops that can be carried by a person, used to prop a door, and subsequently removed and carried away after use.

Related Art

Doorstops have long been used for propping open doors which automatically close. People have tried a number of different approaches to propping open a door that is biased by mechanical force, gravity or otherwise toward the closed position. One of the most common is to block the door open using a heavy object. Another is to use a conventional wedge-shaped doorstop that is inserted between the lower edge of the door and the floor. Unfortunately, each such technique has its own drawbacks so there remains a desire to those in the art to provide improved doorstops that can be used to temporarily hold a door in the open position.

For example, doors used in commercial buildings within the hospitality industry, such as hotels, motels, bed and breakfasts and convention centers are generally equipped with doors that default to a closed position byway of gravity or mechanical devices that bias doors closed. While these doors serve safety functions for security and fire suppression when closed, it is often beneficial to keep such doors open for brief periods of time. Individuals working within commercial buildings, such as bellmen, in-room-dining servers, housekeepers, maintenance personnel, security guards and janitorial service personnel, all have occasions when regular passage through these doors is convenient. In those instances, it is beneficial to use a doorstop or propping device to keep the door open for brief periods of time.

In particular examples relating to commercial buildings, hotel bellmen regularly enter rooms to take luggage into the rooms for guests. Similarly, in-room-dining servers wheel food carts into rooms for guests. Housekeepers move sheets, towels, and other accessories from their cart into rooms for guests. Engineers repair items in rooms and move tools from their cart into rooms. Security guards often need to enter rooms in the case of disturbances and may need to hold a door open while entering a room. Janitorial service personnel enter rooms to clean and typically move cleaning products and tools from their carts into a room. Building maintenance personnel need to enter rooms and keep doors open with door props just like housekeepers, engineers and janitorial workers. Accordingly, many individuals working in commercial buildings need to temporarily keep doors open with a doorstop.

Generally, removable under door doorstops and removable hinge doorstops have been used to temporarily hold the doors open. Additionally, more complex propping systems integrated within the door hinge or frame have also been designed to temporarily hold doors open. In particular, U.S. Pat. No. 7,374,213 by Carlson and U.S. Pat. No. 5,509,235 by Chandler describe doorstops that fit within the gap between the edge of the door and frame hold the door in the open position. However, these doorstops include extensions which connect to the door, frame or hinge and therefore have a larger profile which makes it more difficult to carry or are not separable from the door all together. Similarly, because these designs particularly connect to a portion of the hinge, door or frame, it cannot readily be used in other positions, such as under the door, or on doors that do not have an exposed hinge, such as doors using a piano hinge.

In particular, the '213 patent requires a large profile to effectively prop a door open. In the preferred embodiment the wedge described includes a fastener, such as a screw, and bracket that connects to the wedge and attaches the wedge to the hinge of the door. To allow sufficient room to connect the bracket, the height of the wedge is necessarily greater than the thickness. Additionally, even when the bracket is not used and the height is not necessary to provide room for the fastener and bracket, the profile of the wedge cannot be reduced without changing the principle of operation of the wedge. For example, since the doorstop is made from hard materials and there is no compressible outer layer that could provide additional friction between the door and the frame, the increased surface area of the increased height is necessary to provide enough friction to keep the doorstop in place. Thus, even when the fastener and bracket is removed, the profile of the wedge still cannot be reduced The doorstop described in the '235 patent particularly requires a spring loaded fastening mechanism that permanently holds the doorstop proximate to the door and frame. As described in the '235 patent, the fastening mechanism is attached to a sidewall of the wedge opposite from those that are wedged between the door and frame with the fasteners being parallel to the top and bottom faces of the doorstop, rather than perpendicular to the faces. Further, this fastening mechanism is not intended to be removable and the doorstop is thereby limited to use in a single door. Accordingly, each door necessarily requires its own doorstop where the doorstop cannot be readily used and subsequently repositioned in another door. Thus, there remains a desire to those having any ordinary skill in the art to provide a removable doorstop that can quickly be used in one door and subsequently moved to another door. Further, it is a desire to have an easy carrying system for the doorstop that does not interfere with multiple wedged orientations.

Other examples of doorstops in the prior art include U.S. Pat. No. 7,506,905 George and US Pat. App. No. 2007/0126248 by Mintz which describe removable doorstops that can temporarily be used to hold a door open. However, these references fail to teach or suggest a doorstop that has more than two points of contact between the door and the frame. Accordingly, without a third point of contact, the doorstops only operate with doors sufficiently weighted to hold the doorstop in the wedged position. Therefore, there remains a desire to those having skill in the art to provide a removable doorstop that has a small enough profile to be easily carried by a person but which also has at least three points of contact when wedged between the door and the frame.

In addition, the wedge described in the '248 application can be made from a solid hard, rubberlike material that may effectively provide increased friction between the door and frame while also protecting the frame and door from marring. This material also allows the wedge to be thin where friction is still provided with less surface area. However, since the entire wedge is made from a rubberlike material and does not have a rigid core with a compressible outer layer, the wedge itself will not last as long where the rubber will tend to deteriorate. Further still, the wedge cannot effectively have an aperture for a carabiner, rope, keychain or other fastener where such an aperture will be susceptible to tearing without a more rigid core material. Thus, to carry the wedge, the user necessarily needs a carrying case.

Another doorstop variation is described in U.S. Pat. No. 6,616,128 by Selzer where two wedge doorstops can be placed between the side of a door and a door frame or between the bottom of door and the floor. Further, the doorstop can include carabiner, rope, keychain or other fastener secured within a hole for holding the doorstop. However, since the '128 patent uses relatively hard materials, such as phenolic, resin, or fiberglass material, without any compressible outer layer, the outer surface requires a series of ridges and indentations that help to secure the doorstop and prevent slippage.

Where there are multiple points of contact between the wedge, the doorframe and the door, it is also a desire to those having ordinary skill in the art to provide a wedge that will not damage the door or doorframe as the doorstop is inserted and removed between the door and frame. Frictional material is generally known in the art, such as described in the '235 patent, that is adhered to the sidewalls of the wedge that contact the doorstop to prevent the stop from slipping or sliding away from the door during the initial phase of closing the hinged door to wedge the stop in place. However, it is further a desire to include compressible materials on all sides of the wedge beyond the contacting surfaces so as to protect the door, frame and ground beneath the door from damage as the stop is inserted and removed. Such an improved design will not only provide increased friction between the door and frame to more securely hold the wedge in place but will also assure the wedge, door and frame are not damaged.

SUMMARY OF THE INVENTION

The invention described herein is a wedge doorstop having a pair of adjacent sidewalls that respectively abut one of the edge of a door and a door jamb along with a sidewall connected between the distal ends of the adjacent sidewalls that abuts the frame stop of the doorframe. The wedge is particularly made from a core material having a perimeter that is at least partially surrounded by a compressible material along each one of the sidewalls. In operation, the door is opened and the doorstop is inserted into the gap between the frame and the door, and when the door begins to swing towards the frame, the wedge is sandwiched between the edge of the door and the frame. The outer perimeter of the wedge contacting the door and frame are covered with a compressive material which increases friction in the wedged position. Additionally the compressive material prevents the doorstop from damaging the door or frame while the stronger core provides structure and rigidity.

Another aspect of the doorstop according to the preferred embodiment is a stepped section that is designed to receive a gasket of the doorframe that is often found between the frame stop and jamb. Alternatively, the stepped section itself can engage the frame stop of the frame while one sidewall of the wedge engages the jamb and the adjacent sidewall engages the edge of the door. Regardless of whether the sidewall that connects to the distal end of one of the adjacent sides contacts the frame stop or the stepped section contacts the frame stop, the wedge has three points of contact between the frame and the door to securely hold the wedge between the door and the frame and retain the door in an open position.

In another aspect of the invention described herein, the doorstop doubles as a traditional under door doorstop where the third sidewall opposite from the angle connected between the distal ends of the two adjacent sidewalls can engage the bottom edge of the door. Thus, the wedge design can not only be inserted into the gap between the door and the frame in one orientation, it can also be inserted between the ground and bottom edge of the door in another orientation and thus allow the user to select where the user wants to engage the door to hold it in an open position. Accordingly, the same doorstop can be used by a person in a traditional fashion underneath the door as well as in the intended orientation where the doorstop has three points of contact with the door and frame as described herein.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1C:
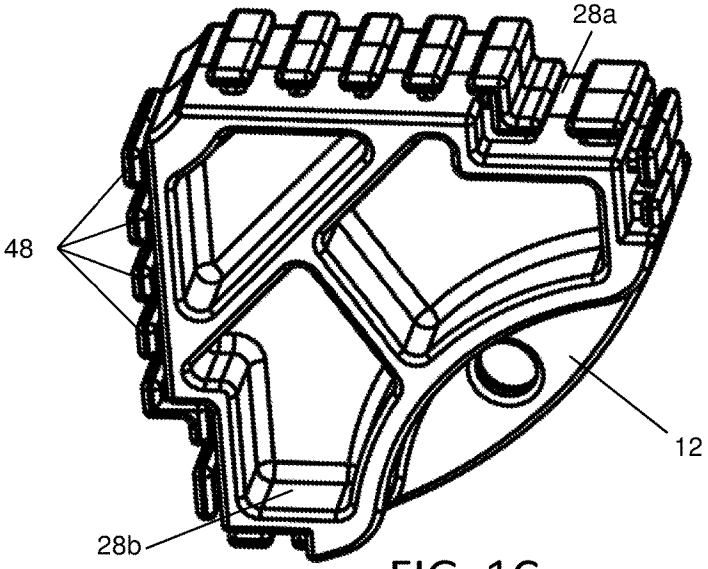
FIGS. 1C and 1D respectively show exploded detail views of the rigid core and compressible perimeter according to the doorstop described herein.

The following description of the preferred embodiment(s) is merely exemplary in nature and is in no way intended to limit the invention, its application, or uses.

The invention described herein is a wedge doorstop having a pair of adjacent sidewalls that respectively abut an edge of a door and a doorframe when positioned in the gap between a door and a doorframe. Alternatively, in another orientation the wedge can be used beneath the door where one sidewall of the wedge contacts the bottom edge of the door and another sidewall of the wedge contacts the ground beneath the door to hold it open. Regardless of the orientation in which the wedge is used, it is an aspect of the invention to have a rigid core structure that is covered by an outer layer formed by a compressible material along the multiple contact sidewalls of the wedge. The compressible outer layer protects the hard material of the wedge's core from damage, such as from chipping, and prevents the rigid core from contacting and possibly scuffing or otherwise damaging the sides of the door and door frame where the wedge is placed or the floor. The compressible outer layer also to provides a gripping means and additional friction when the doorstop is in use to better maintain the wedged position which can be either between the door and the frame or between the bottom edge of the door and the floor. It will be appreciated that when the wedge is positioned on the floor and engages the bottom of the door, only the side of the wedge that engages the floor needs to have the compressible outer layer to provide the increased friction to prevent the wedge from being pushed along the floor.

In operation with the doorstop positioned between the frame of the door and the door, the door is opened and the doorstop is inserted into the gap between the frame and the door. When the door begins to swing towards the frame, the wedge is sandwiched between the edge of the door and the frame with the door subsequently held open. The compressible outer layer material along the sidewalls of the core slightly deforms from the force of the door's closure mechanism pulling the door closed, and the doorstop is thereby securely wedged in place. Additionally the compressive material prevents the doorstop from damaging the door or frame.

In addition to contacting the jamb and the edge of the door, the sidewall of the wedge that contacts the frame of the door preferably includes not only a section that abuts the jamb of the door frame but also at least one stepped section at the distal end which can receive a gasket situated between the jamb and frame stop or can be used with the stepped section itself abutting the frame stop of the jamb. Accordingly, in the preferred method of use when the wedge is positioned between the frame and the door, the wedge preferably has three points of contact between the edge of the door, jamb and frame.

In comparison, when the wedge is used beneath the door, there are only two contact points between the ground and the door. Accordingly, the doorstop can adequately engage the bottom of the door in addition to the frame and door rather than being limited to a particular orientation. When the doorstop is used beneath the door, it does not have to overcome gravity to remain in position and the doorstop can be forced tightly under the door whereas when the doorstop is between the door and the frame, it is the amount of force provided by the door closure mechanism that results in the friction that prevents the doorstop from falling out of its position. Additionally, three contact points are achieved by wedging the doorstop between the door and frame, and the door is secured without any additional fasteners or protrusions connecting or otherwise attaching the doorstop to the frame or door.

Figure 6A:
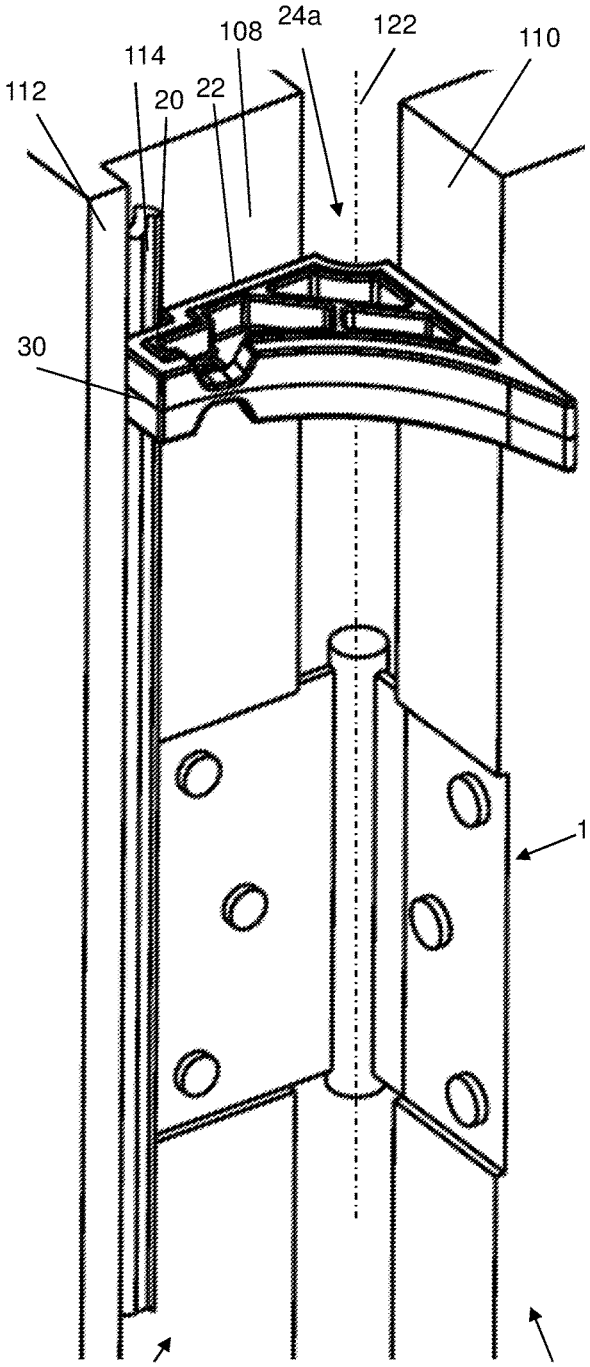
FIGS. 6A and 6B show a wedge doorstop between a door and a frame with a gasket propping the door open.
Figure 6B:
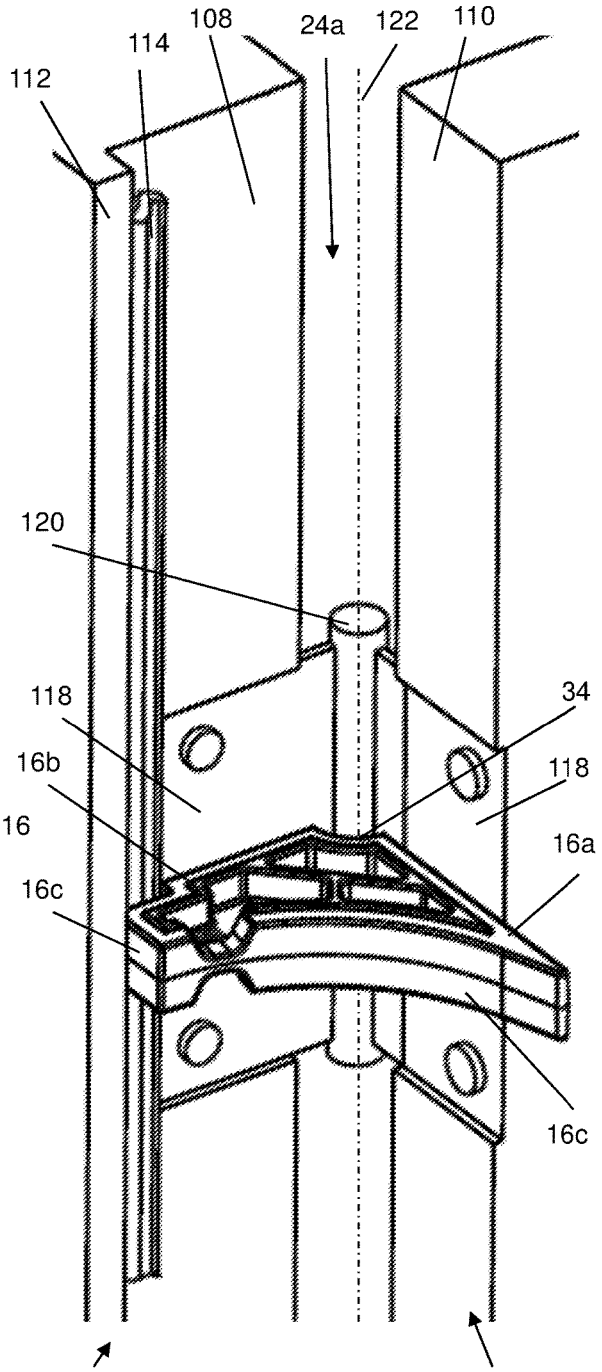
Figure 7A:
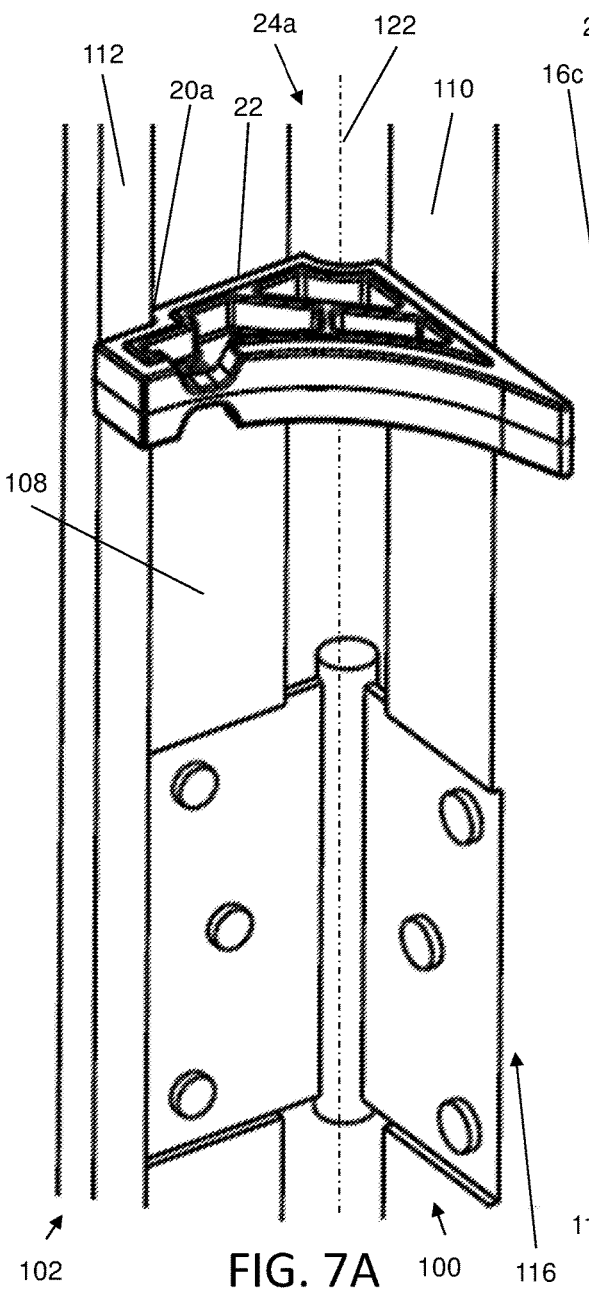
FIGS. 7A and 7B show a wedge doorstop between a door and a door frame with a gasket propping the door open.

The doorstop is a wedge 10 preferably having a triangular shape with at least three sidewalls 16 intended to contact one of the door 100 and doorframe 102 when used in a first orientation 24*a* between the gap of the door and the frame in the engaged position, as shown in FIGS. 6 and 7. Alternatively, the wedge can be used in a second orientation 24*b* between the ground 104 and the bottom edge 106 of the door where only two sidewalls of the wedge contact one of the ground and the door, as shown in FIG. 8. In the preferred first orientation, one of the wedge has a first adjacent sidewall 16*a* for contacting one of the jamb 108 of the doorframe and the edge of the hinge stile 110 of the door along with a second sidewall 16*b* adjacent to the first sidewall that contacts the opposite jamb or hinge stile from the first sidewall. Additionally, a third sidewall 16*c* connected between the adjacent first and second sidewalls contacts the frame stop 112 at one of the third sidewalls ends. Accordingly, the end of the third sidewall may contact the frame stop proximate to the distal end of either adjacent sidewall.

Figure 3A:
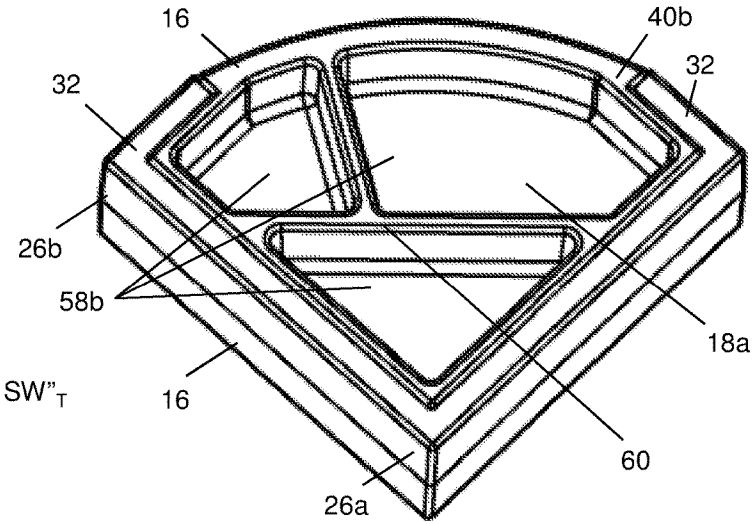
FIGS. 2A-2B and 3A-3B illustrate doorstop embodiments having a convex third sidewall according to the invention described herein.

The wedge is comprised of a rigid internal core 12, shown in FIG. 1C, with a compressible material 14 attached on at least three of the sidewalls of the rigid core. Accordingly, the rigid core provides sufficient strength to the wedge to support the weight of door biased towards the closed position and subsequently hold it in an open position. However, the compressible perimeter prevents the rigid core from damaging the door or frame when the wedge is being used as well as increasing the frictional forces between the wedge, door and frame so as to better secure the wedge in place. Preferably, the rigid core is formed by a skeletal structure which has one or more cross members 54 extending between and connecting the outer sidewalls of the rigid core, and the internal spaces 56 between the cross members and the outer sidewalls can be a solid 58*a* as shown with a logo and dimensional information in FIG. 2, or may form a web with open internal spaces 58*b* between the solid skeletal cross members as depicted in FIG. 3A. It will also be appreciated that the rigid core could be solid through its entire thickness without any openings or web or may also be a shell with a hollow interior space without any cross members between the backsides of the faces.

The core comprises a top face 18*a* and bottom face 18*b* that are substantially parallel to the ground when the wedge is engaged between the door and doorframe and perpendicular to the ground when the wedge is positioned beneath the door. Generally shown in FIGS. 1A and 1B, the wedge has three sidewalls around the perimeter of the core that separate the topside and bottom side by their respective thicknesses. The first sidewall and second sidewall are adjacent to one another and connected at an angle ($\alpha$) at their proximal ends 26*a*. In addition, the ends 30 of the third sidewall are connected to the respective distal ends 26*b* of the first sidewall and the second sidewall. Thus, the connected sidewalls generally form a triangularly shaped wedge with the third side being opposite from the angle connecting the adjacent sides. Each side of the wedge has a front side 28*a* that engages the door, doorframe or ground in the various orientations as explained below and a backside 28*b*. To provide stability to the rigid core section, a cross member is also provided which at least connects to the backside of the adjacent sidewall and which may also connect to the backside of the third side.

Although the structure of the cross member is not intended to be limiting, it may include a solid skeletal structure filling the space between the respective sidewalls, as shown in the Figures, or it may be a partial skeletal structure that does not entirely fill the space between the respective sidewalls. Accordingly, the cross member provides rigidity but is generally made from a lightweight material to reduce the overall weight of the wedge. As shown in the Figures, the preferred skeletal structure fills the entire space between the sidewalls but has a varying thickness where the thickness of the wedge is not uniform between each side. As shown in the drawings, a skeletal "K"

shape 60 is used in the preferred design with thin internal sections between the segments of the "K" design. Similarly, it will be appreciated by those having an ordinary skill in the art that other skeletal structures could be used within the core of the wedge to provide sufficient strength to the rigid core.

In the preferred embodiment the angle between the adjacent sidewalls of the wedge is approximately equal to 90°. Accordingly, the opposite third sidewall is the hypotenuse of a right triangle and the ends of the third sidewall may contact the frame stop when the wedge is positioned between the frame and door. Alternatively, the third side may contact the bottom edge of the door and the wedge can be used as an under-door stop, such as shown in FIG. 8.

Figure 1D:
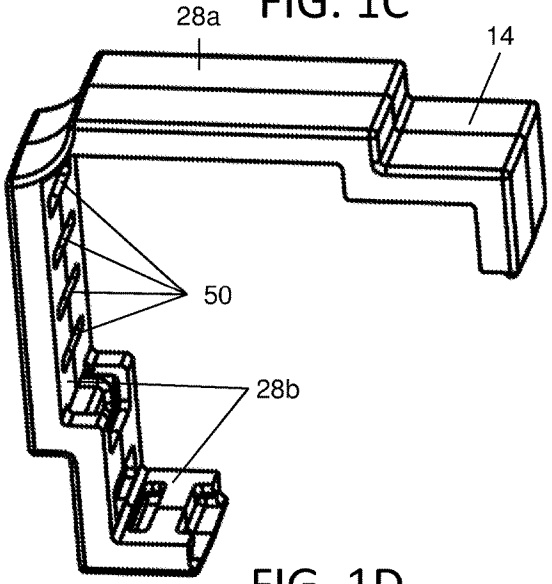
Figure 1A:
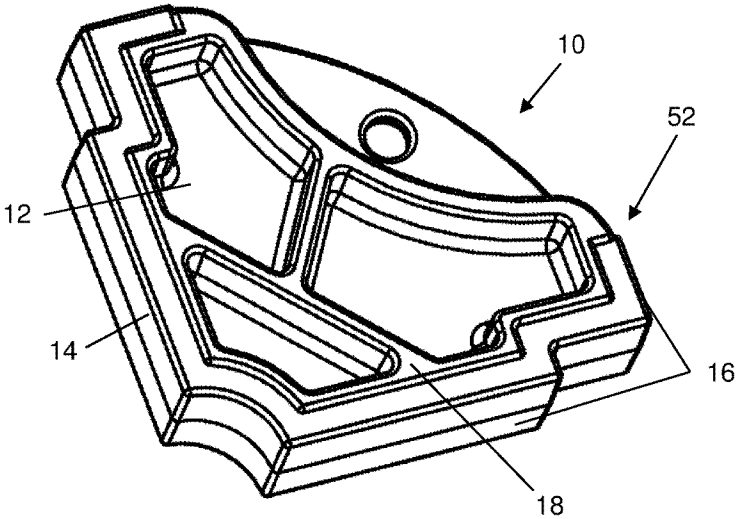
FIGS. 1A and 1B respectively depict a perspective and plan view of a doorstop having a convex third sidewall according to the invention described herein.
Figure 1B:
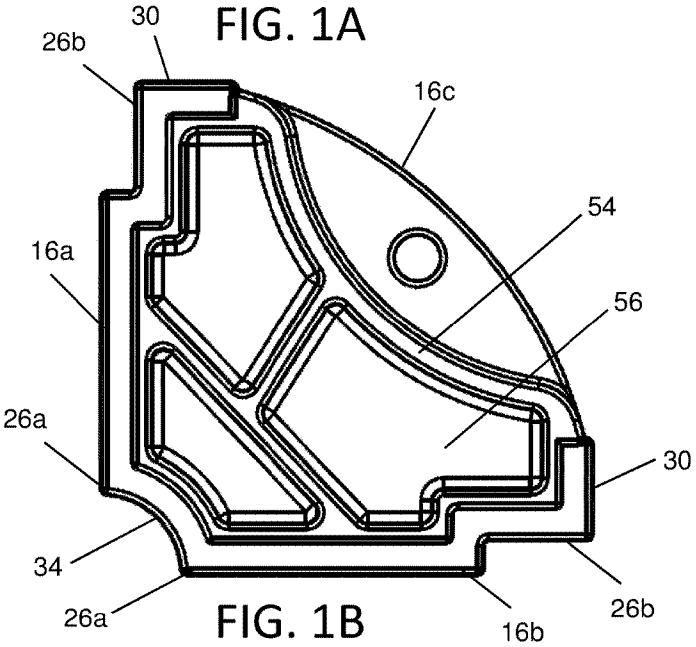

In another aspect of the wedge doorstop, a compressible material, particularly shown in FIG. 1D, is attached around the sidewalls of the rigid core and provides a deformable perimeter. The interior core of the wedge is a strong substrate material with each sidewall being fully or partially covered by a durable rubbery overlay material that keeps the doorstop in place and prevents the wedge from sliding down the door when positioned between the door and the frame. Preferably, the core material is formed from plastic but it will be appreciated by those having an ordinary skill in the art that other materials could be used, including but not limited to aluminum, wood or similar rigid materials. Similarly, the compressible perimeter prevents the wedge from sliding on the ground when positioned beneath the door. In particular, the entirety of the first sidewall and the second sidewall are covered with the compressible material and at least a portion 32 of the third sidewall is covered with the compressible material. Accordingly, a cushion is provided between the doorstop, the frame and the door that prevents marring, especially on wooden doors and frames.

Although the means by which the compressible outer perimeter may be permanently or removably attached to the rigid core is not intended to be limiting, the preferred wedge provides a snap fit 52 between the outer sidewall of the core and the inner sidewall of the compressible material. As depicted in FIG. 1C, each sidewall of the rigid core preferably includes multiple protuberances 48 which seat within chambers 50 in the inner surface of the compressible material as shown in FIG. 1D. The protuberances preferably have a shank and a head with the head being larger than the shank, and the recesses preferably have an opening that expands into a chamber so that the chamber is larger than the opening and is sized to fit the head. With the flexible material of the outer layer, the opening can stretch to allow the head to pass through into the chamber and then returns to its normal size around the stem to lock the head within the chamber. Accordingly, the opening of each chamber within the compressible perimeter snaps over a corresponding head of a protuberance so that the head is situated within the chamber, and the opening surrounds the stem so that the outer layer has a snap-fit connection with the core. In such an embodiment the compressible perimeter is removable and can be replaced as needed. Alternatively, other embodiments may include a compressible material that is connected with a permanent adhesive or other removable fasteners, such as hook and loop fasteners or snaps.

The doorstop described herein does not need to be connected to the door or frame in order to stay in place wherein the compressible material increases friction for a more secure fit as well as protects the door, frame and wedge. In comparison, other doorstops are made of hard, rough, plastic that can damage a door and are less effective at holding doors open and preventing damage to the door and frame, such as with many of the other doorstops in the prior art which are often hung on a door hinge pin or otherwise connected to the door or frame. Further still, doorstops that do include a compressible outer surface are generally limited to compressible or less rigid sections on a limited number of sidewalls. These compressible materials are positioned on surfaces of the doorstop that are intended to contact the surface of the door or frame and provide friction to more securely hold the doorstop in place. Accordingly, these doorstops do not include compressible materials on all sides that protect the doorstop, door and frame during insertion and removal. Such protection is particularly necessary in the doorstop described herein where it does not fasten to the door or frame and therefore is fully removed when it is not being used rather than rotating between an engaged position and a disengaged position relative to a pivoting fastener, as in the prior art.

It is another aspect of the doorstop wedge to provide three points of contact between the frame and the door when the wedge is positioned in the gap between the door and frame. When wedged between the door and frame, the front side of one of the adjacent sidewalls of the wedge contacts the jamb of the doorframe with the front side of the other adjacent sidewall contacting the edge stile of the door, as shown in FIG. 6 and further described below. To provide a third contact point, one of the ends of the third sidewall contacts the frame stop of the doorframe. Alternatively, the stepped section positioned at the distal end of one or both of the adjacent sidewall can contact the frame stop instead of the third sidewall as shown in FIG. 7 and further described below.

Alternatively, the wedge can be positioned beneath the door with two points of contact provided between the bottom edge of the door and the ground beneath the door as shown in FIG. 8. In operation, one of the adjacent sidewalls contacts the ground beneath the door and the front side of the third sidewall contacts the bottom rail of the door in the second orientation. Accordingly, the wedge can be used in multiple orientations where the wedge is be inserted between the edge of the door and the doorframe anywhere along the hinge stile edge of the door in a first orientation and beneath the door in a second orientation. In this first orientation the user does not necessarily need to bend over like they would need to do with a traditional doorstop that only fits under the bottom of the door. However, the wedge can be repositioned into the second orientation if the user so chooses. With other doorstops that fit under a door or within the gap between the frame and door, the user can only use the doorstop in a single orientation and cannot select the point of engagement whereas the wedge described herein provides various orientations and thus allows the user to decide how they would like to use the wedge.

Although the wedge can be used in the first orientation regardless of the shape of the third sidewall, it is preferred that the wedge include a concave 40*a* or straight third sidewall so that the wedge can be used in the second orientation beneath the door. As shown in FIG. 8, the concave third sidewall contacts the bottom edge of the door frame and one of the adjacent sidewalls contacts the ground beneath the door. Although it is preferred that a concave sidewall be used, it will be appreciated that a straight or slightly convex 40*b* sidewall can be used so long as the distal end of one of the adjacent sidewalls and a portion of the third side can slide underneath the bottom of the door. However, a concave shape is preferred where such shape can slide further underneath the door than a straight or convex sidewall.

In the preferred embodiment, the wedge also includes a stepped section 20 on the distal end of at least one of the adjacent sidewalls as depicted in FIGS. 1, 2, 4 and 5. The stepped section includes a distal end 20*b* forming the distal end of the adjacent side and a ledge 20*a* that is spaced from the distal end by the length of the step ($SS_L$). Subsequently, the first section 22 of the sidewall extends from the ledge to the proximal end of the sidewall where the length of the first section of the sidewall ($SWS_L$) and the step length collectively form the length of the sidewall ($SW_L$) ($SWS_L+SS_L=SW_L$). The ledge of the stepped section is preferably at a right angle (β) from the first section of the sidewall and the length of the stepped section is generally parallel to the jamb. However, it will be appreciated by those having an ordinary skill in the art that the angle of the ledge may vary to accommodate irregularly shaped gaskets or frame stops that may not be at a right angle relative to the jamb where the stepped section either receives the gasket in the preferred embodiment or can contact the frame stop in an alternative embodiment. As with the overall size of the wedge described below, the stepped section can be sized to accommodate various frame sizes.

Figure 5A:
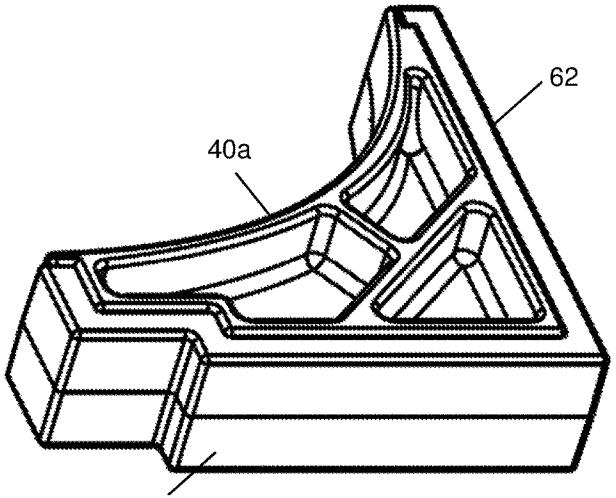
FIGS. 4A-4B and 5A-5B illustrate doorstop embodiments having a concave third sidewall according to the invention described herein.
Figure 5B:
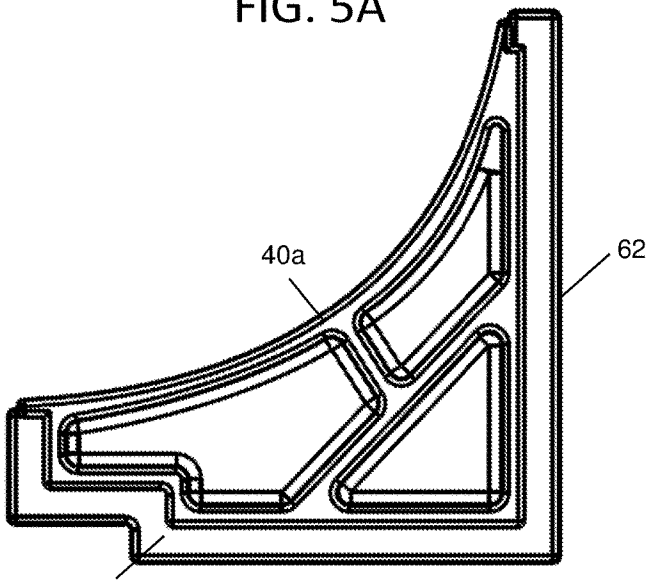

In an alternative embodiment, the adjacent sidewalls of the wedge are continuous and do not have a stepped section. In another embodiment, the wedge may have a single stepped section on only one of the adjacent sidewalls, such as shown in FIGS. 4 and 5, and a continuous adjacent side 62 that contacts the edge of the door while the side with the stepped section 64 contacts the frame. In such an embodiment the wedge can be used in the first orientation engaging the frame and side edge of the door or the second orientation engaging the ground with one of the adjacent sidewalls and bottom edge of the door with the third sidewall connected between the distal ends of the adjacent sidewalls.

In the preferred first orientation, the wedge contacts the doorframe and the door as shown in FIGS. 6 and 7 and referenced above. In the preferred orientation shown in FIG. 6, the stepped section of the wedge receives a gasket 114 positioned between the frame stop and the jam. Commonly, rubber or gaskets of similar material are used within door frames to provide a better seal between the frame and door when the door is closed. Accordingly, the stepped section which is offset from the sidewall of the wedge contacting the jam may be included, as described above, so that the gasket can be positioned between the stepped section and the jamb. When a stepped section is not provided, the gasket may tend to bias the distal end of the wedge away from the jamb and thereby lower the effectiveness of the wedge in the first orientation where less surface area on the sidewall of the wedge contacts the jamb. For example, the gasket may prevent the first section of the sidewall from flushly contacting the jamb of the frame if no stepped section is provided. In an alternative orientation shown in FIG. 7, the first section of the sidewall between the proximal end and the frame stop contacts the jamb of the frame and the ledge of the stepped section contacts the frame stop. Accordingly, the stepped section can fit around the frame stop and provide the third point of contact for the wedge.

Figure 7B:
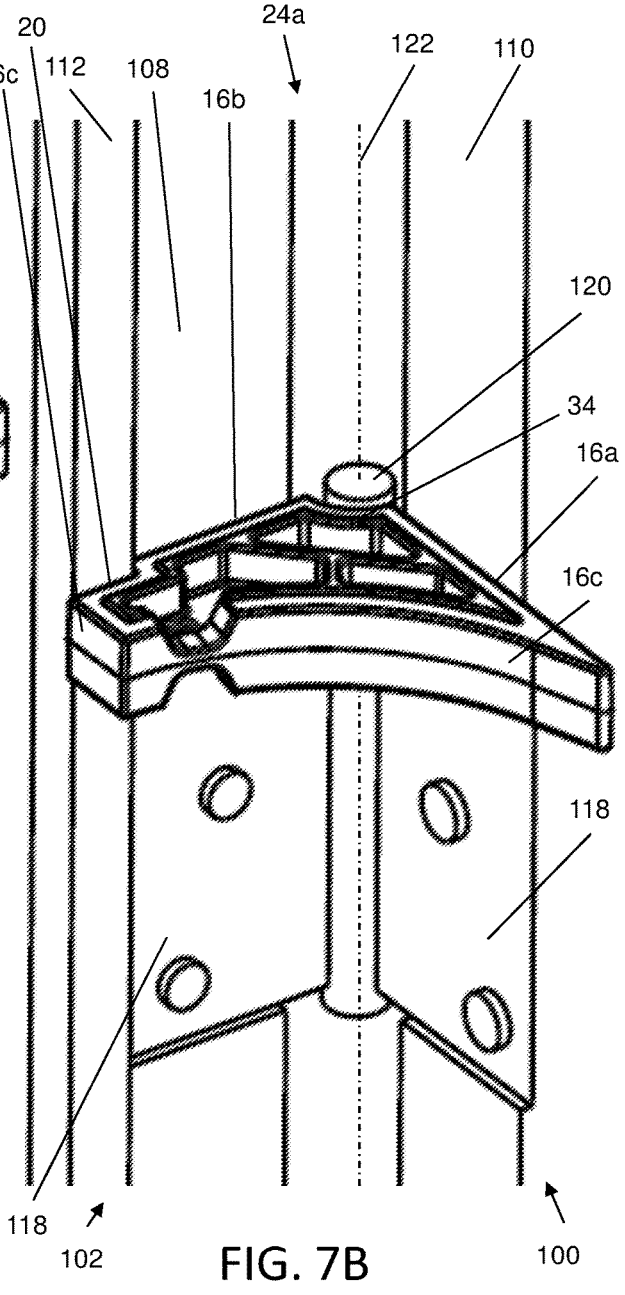
Figure 8:
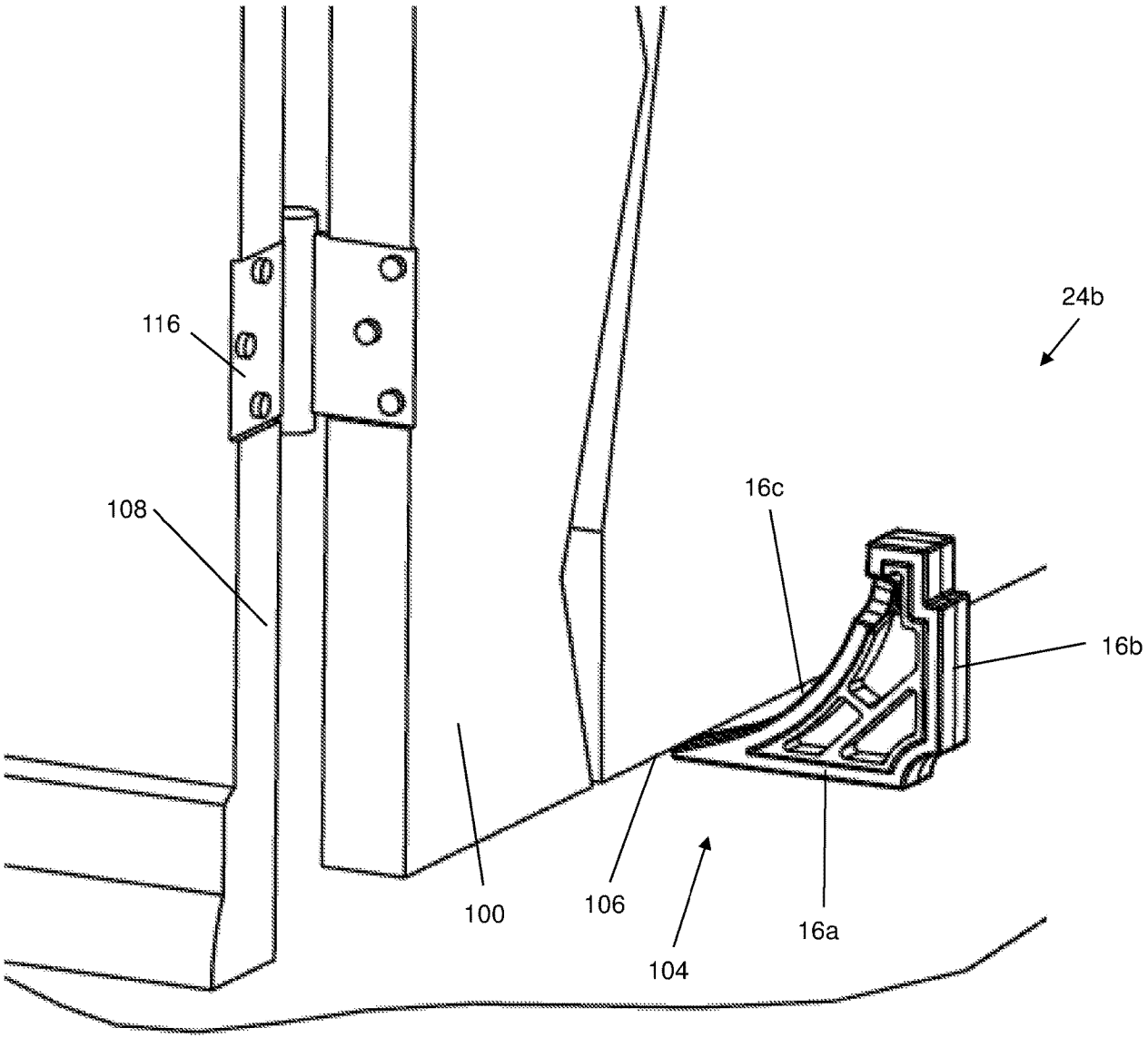
FIG. 8 shows a wedge doorstop between a door and the floor propping the door open.

As hinges 116 are used to hang doors, the wedge may be positioned proximate to the hinge and contact the respective hinge plates 118 on the edge of the door and frame as depicted in FIGS. 6B and 7B. In such a position it is preferred to use a wedge doorstop having a hinge cutout 34 between the adjacent sidewalls of the wedge. In this position the sidewalls of the wedge contact the hinge plates that respectively attach to the door and the frame while an end of the sidewall of the wedge opposite from the angle that is connected between the distal ends of the adjacent sidewalls contacts the frame stop as described above.

Figure 3B:
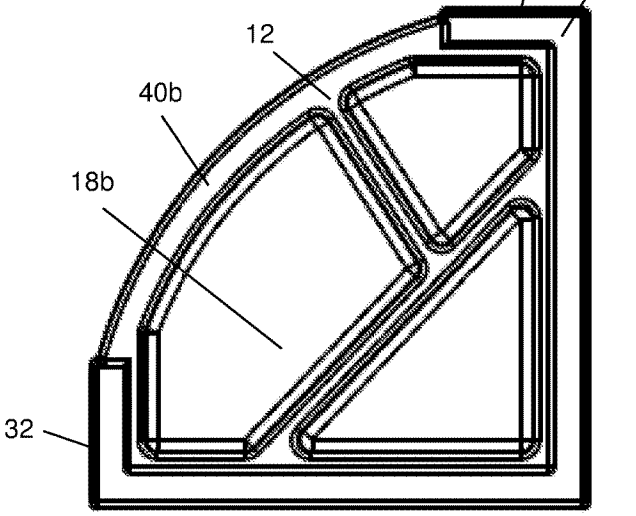

To further assure that the wedge is secured within the gap between the door and frame, the hinge pin 120 protruding into the gap is seated within the hinge cutout. Thus, the hinge pin cutout, such as shown in FIGS. 1 and 4, has a radius (r) between the proximal ends of the adjacent sidewalls that varies relative to the size of the hinge. In an alternative position, the hinge pin cutout is not situated proximate to the hinge, such as when it is used in the gap between the frame and door in between the hinges. However, the hinge pin cutout surrounds the pivot axis 122 of the hinge pin that pivotally attaches the door to the frame. Alternatively, no hinge pin cutout is provided as shown in FIGS. 2, 3 and 5.

Additionally, the wedge doorstop described herein can be used be used on doors with piano hinges which connect doors to frames along the entire vertical height of the door. In comparison, doorstops that fit onto the door hinge pins do not work on doors with piano hinges. Further still, other doorstops fit onto the hinge pin of one of the hinges that attach a door to a doorframe and therefore cannot be used on doors with piano hinges where no gap is provided between the door and the frame. Additionally, the hinge cutout is capable of accommodating the circumference of the hinge when a piano hinge is used.

Figure 2A:
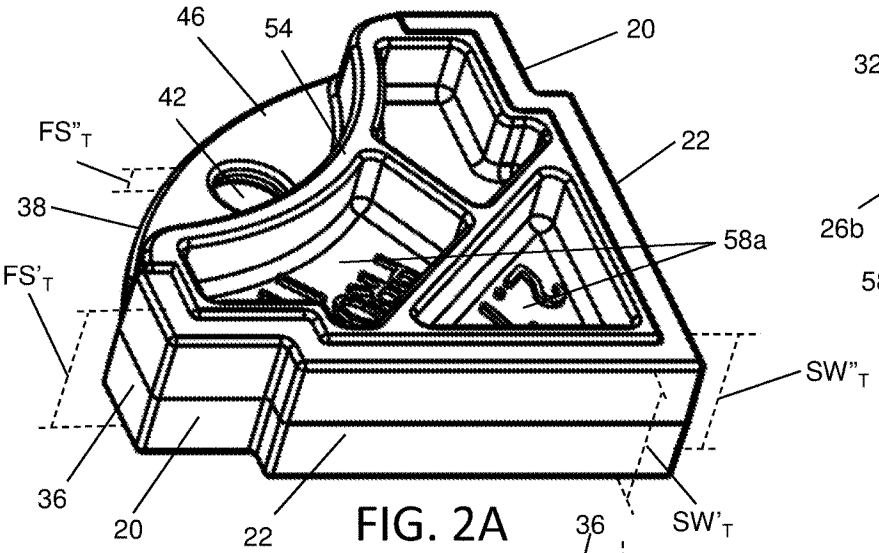
Figure 2B:
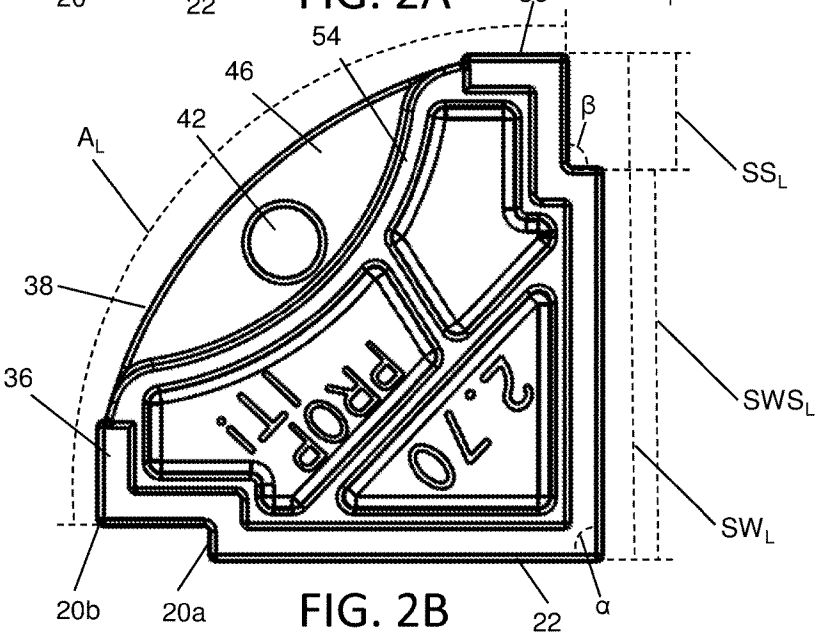
Figure 4A:
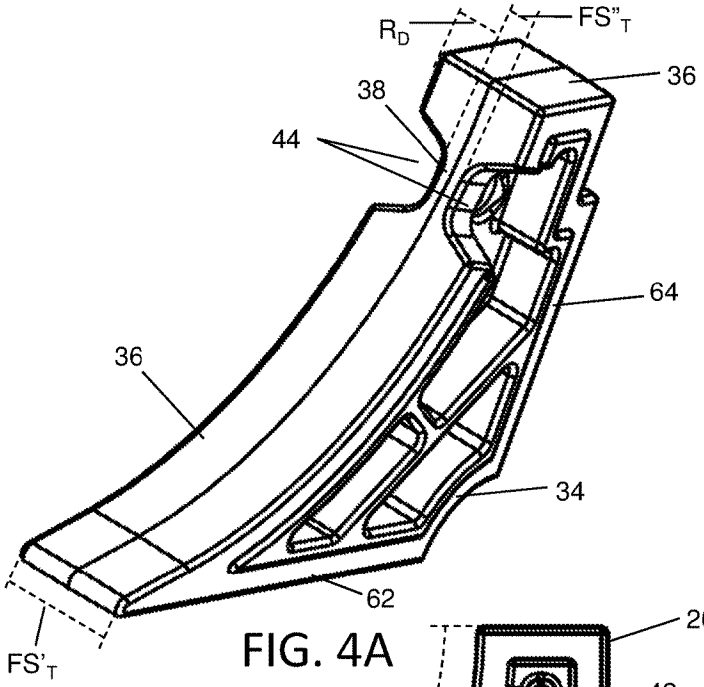
Figure 4B:
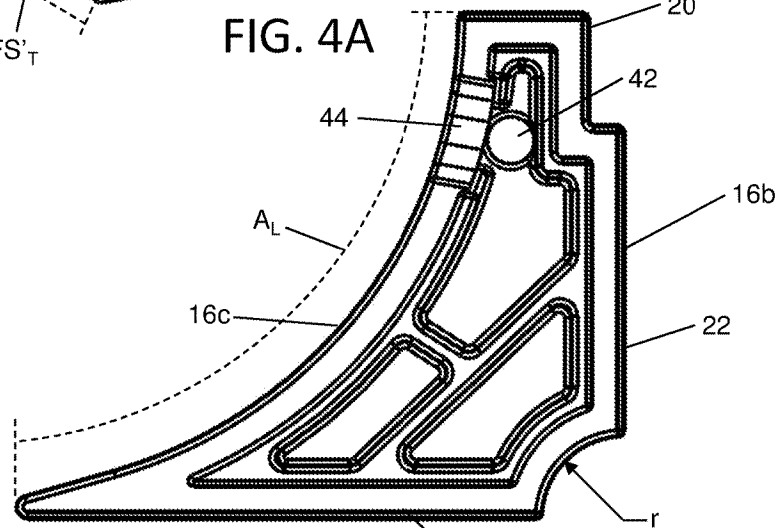

Regardless of the chosen embodiment, it is an aspect of the wedge doorstop to have a low profile where the wedge is thin, with its largest dimension being only a few inches long and the overall thickness being less than its largest dimension. In the preferred embodiment, the wedge assembly is kept to such a small size, in order to make it more convenient to carry and use, preferably with the thickness being less than half the span width of the doorstop between the sidewalls of the rigid core. The wedge includes a perimeter edge along each sidewall wherein each sidewall has a thickness ($SW_T$). As illustrated in FIGS. 2A and 4A, the thickness of the adjacent first and second sidewalls are equal ($SW'_T=SW''_T$) and the third sidewall has a first section 36 with a thickness ($FS'_T$) that is approximately equal to the thickness of the first and second sidewalls ($FS'_T=SW'_T=SW''_T$) and a second section 38 with a thickness ($FS''_T$) that is less than half the thickness of the first sidewall, the second sidewalls and the first section of the third sidewall ($FS''_T<\frac{1}{2}FS'_T$ & $\frac{1}{2}SW'_T$ & $\frac{1}{2}SW''_T$). To maintain a low profile, the largest thickness of the sidewalls is preferably less than one fourth the length of each sidewall between their respective ends that are connected to one another as described herein ($SW_T<\frac{1}{4}SW_L$).

As outlined above, the third sidewall preferably has a curved shape and accordingly has an arc length ($A_L$) between the opposing ends that connect to the distal ends of the adjacent sidewalls. As with the lengths of the adjacent sidewalls, the arc length is also greater than the largest thickness of the wedge that separates the top face from the bottom face ($A_L>SW_T$). However, alternative designs may have a variable arc length that changes as the angle between the adjacent sidewalls moves.

The wedge also preferably includes an easy means of carrying. Although the wedge is designed to have a thickness of less than one inch so it fits in a pants pocket easily and comfortably, a hole 42 for a carabiner, rope, keychain or other fastener is also provided so that it can be clipped onto a belt, pant loop, janitorial cart, tool box or similar device. As shown in the drawings, a hole is provided proximate to the perimeter of the third sidewall that can be used to secure a carabiner, rope, keychain or other fastener. Additionally, it will be appreciated that the size of the hole may vary relative to the size of the wedge and as desired by the user. Thus, as other doorstops are often too thick or too bulky to fit easily and comfortably in a pocket, the wedge described herein not only has a low profile to fit within a pant pocket, but also has a means for carrying the wedge if a larger design is needed.

As referenced above, a section of the third sidewall has a thickness that is less than the thickness of the other section of the third sidewall as well as the second sidewall and the first sidewall so that the carabiner, rope, keychain or other fastener has clearance to easily fit within the hole. To provide such clearance to the aperture, embodiments with a concave third sidewall shape that are particularly suited for positioning beneath the door include a pair of recess 44 on opposite sides of the core that are separated a recessed depth ($R_D$) from the opposing faces. The distance between each recess defines the thickness of the second section ($FS''_T$) of the third sidewall, which is less than the first section thickness, as illustrated in FIG. 4A. Conversely, a planar section 46 can be incorporated with embodiments having a convex third sidewall that is not particularly well suited for use beneath the door. As particularly shown in FIGS. 1A and 2A, this planar section extends from the cross member to the perimeter of the third sidewall and defines the second section thickness ($FS''_T$) of the third sidewall that is substantially less than the first section thickness proximal to the distal ends of the adjacent sidewalls. Accordingly, the fastener can be easily slid over the planar section and engage the aperture positioned there. Although it is preferred to use recesses in embodiments having a concave third sidewall and a planar section in embodiments having a convex third section, it will be appreciated that both the recesses and the planar section could effectively be used with within a concave or convex embodiment.

Generally, the doorstop described herein is designed with a 90° angle (a) between the adjacent sidewalls, as illustrated in FIGS. 1B, 2B, 3B, 4B and 5B, and thus the wedge keeps the door open to 90° when fully engaged. Keeping a door open 90° is the default opening and is typical for most users. However, other angles may be used, such as when a bellman may want to open a door to 70° to allow access to a closet behind the door while bringing luggage into the room. Accordingly, in the preferred embodiment the wedge will hold doors open at 90° by having a 90° angle between the sidewall that contacts the edge of the door and the sidewall that contacts the jamb and frame stop. However, it will be appreciated by those having an ordinary skill in the art that this angle could be varied to provide alternative opening angles, such as at 60°, 45°, 30° or 70° as in the example described above.

In alternative embodiments, the wedge may also include alternative wedge angles into a single doorstop, such as with faceted sidewalls on opposite sides of the wedge or a mechanically actuated cross member. Additionally, the sidewalls may be curved on opposite sides of the wedge to allow for a range of angles rather than set angles according to the faceted sidewalls. Similarly, it will be appreciated by those having an ordinary skill in the art that an adjustable angle wedge may be used according to the innovation described herein to provide a wedge doorstop capable of holding open a door at different angles. However, moving parts within an adjustable wedge is not preferred where it is an aspect of the invention to be easy to use without the complexity of moving pieces.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A wedge stop for a door in a doorframe, comprising:

a rigid core comprising a pair of faces, a first sidewall, a second sidewall, and a third sidewall, wherein the first sidewall, the second sidewall and third sidewall each comprise a front side and a backside, wherein the first sidewall and the second sidewall each further comprise a proximal end and a distal end, wherein the distal end is separated from the proximal end by a sidewall length, wherein the proximal end of the first sidewall is adjacent to the proximal end of the second sidewall and is positioned at an angle relative thereto, wherein the third sidewall further comprises a pair of ends respectively connected to the distal end of the first sidewall and the distal end of the second sidewall, and wherein the third sidewall is opposite from the angle; and a compressible outer layer attached to the first sidewall, the second sidewall, and the third sidewall, wherein the compressible outer layer is more flexible than the rigid core, and wherein the compressible outer layer covers the front side of the first sidewall, the front side of the second sidewall, and at least a portion of the front side of the third sidewall.

2. The wedge of claim 1, wherein one of the front side of the first sidewall and the front side of the second sidewall contacts an edge stile of the door in a first orientation, wherein the other of the front side of the first sidewall and the front side of the second sidewall contacts a jamb of the doorframe in the first orientation, wherein one of the distal end of the first sidewall, the distal end of the second sidewall and the front side of the third sidewall contacts a frame stop of the door frame in the first orientation, wherein one of the front side of the first sidewall and the front side of the second sidewall contacts a ground section beneath the door in a second orientation, and wherein the front side of the third sidewall contacts a bottom rail of the door in the second orientation.

3. The wedge of claim 2, wherein at least one of the first sidewall and the second sidewall further comprise a first section and a stepped section, wherein the stepped section comprises a step length between a step distal end and a ledge, wherein the step distal end is positioned at the distal end of one of the first sidewall and the second sidewall, wherein the step length is less than one fourth of the sidewall length, wherein the first section extends from the proximal end of one of the first sidewall and the second sidewall to the ledge, wherein the first section contacts the jamb in the first orientation, and wherein one of the front side of the third sidewall and the ledge of the stepped section contacts the frame stop of the doorframe in the first orientation.

4. The wedge of claim 2, wherein the rigid core further comprises a hinge pin cutout positioned between the adjacent proximal ends of the first sidewall and the second sidewall, wherein the hinge pin cutout comprises a radius, and wherein the hinge pin cutout is situated around an axis extending through a hinge pin in a hinge pivotally connecting the doorframe and the door in the first orientation.

5. The wedge of claim 1, wherein the first sidewall, the second sidewall and the third sidewall respectively comprise a first sidewall thickness, a second sidewall thickness and a third sidewall thickness between the first face and the second face, wherein the first sidewall thickness and the second sidewall thickness are approximately equal, and wherein the third sidewall thickness is no greater than the first thickness and the second thickness.

6. The wedge of claim 5, wherein the third sidewall thickness further comprises a first section thickness and a second section thickness, wherein the first section thickness is approximately equal to the first thickness and the second thickness, and wherein the second section thickness is less than half the first thickness, the second thickness and the first section thickness.

7. The wedge of claim 6, wherein third sidewall further comprises a concave shape, wherein the concave shape comprises an arc length between the pair of ends of the third sidewall, wherein the first sidewall thickness, the second sidewall thickness and the third sidewall thickness are less than one fourth the sidewall length and the arc length, wherein the rigid core further comprises an aperture, wherein the third sidewall further comprises a pair of recesses respectively positioned on opposite sides of the rigid core, wherein the pair of recesses respectively comprise a recessed depth, wherein a distance between the recessed depth is equal to the second section thickness, and wherein the aperture is situated proximate to the pair of recesses.

8. The wedge of claim 6, wherein third sidewall further comprises a convex shape, wherein a planar section connects between the backside of the third sidewall along the second section thickness and a cross member, wherein the cross member is connected between the backside of the first face and the backside of the second face, wherein the planar section comprises a planar thickness equal to the second section thickness, and wherein an aperture is positioned within the planar section.

9. The wedge of claim 1, wherein the rigid core further comprises a plurality of protuberances protruding from the front side of each of the first sidewall, the second sidewall, and the third sidewall, wherein the compressible outer layer further comprises an inner surface and an outer surface, wherein the inner surface comprises a plurality of chambers, and wherein the plurality of protuberances are secured within the plurality of chambers with a snap fit.

10. The wedge of claim 1, wherein the rigid core further comprises a cross member connected between the backside of the first face and the backside of the second face, wherein the cross member comprises at least one of a solid core, a webbed core, and an open core, wherein the solid core comprises a solid section between the pair of faces, wherein the webbed core comprises a series of solid sections between the pair of faces and a series of open sections between the faces, and wherein the open core comprises an open section between the pair of faces.

11. The wedge of claim 10, wherein the cross member further comprises the third sidewall.

12. A wedge stop for a door in a doorframe, comprising:

a rigid core comprising a pair of faces, a first sidewall, a second sidewall, and a third sidewall, wherein the first sidewall, the second sidewall and the third sidewall each comprise a front side and a backside, wherein the first sidewall and the second sidewall each further comprise a proximal end and a distal end, wherein the distal end is separated from the proximal end by a sidewall length, wherein the proximal end of the first sidewall is adjacent to the proximal end of the second sidewall and is positioned at an angle relative thereto, wherein the third sidewall further comprises a pair of ends respectively connected to the distal end of the first sidewall and the distal end of the second sidewall, and wherein the third sidewall is opposite from the angle; and a compressible outer layer attached to the first sidewall, the second sidewall, and the third sidewall, wherein the compressible outer layer is more flexible than the rigid core, wherein the compressible outer layer covers the front side of the first sidewall, the front side of the second sidewall, and at least a portion of the front side of the third sidewall, wherein one of the front side of the first sidewall and the front side of the second sidewall contacts an edge stile of the door in a first orientation, wherein the other of the front side of the first sidewall and the front side of the second sidewall contacts a jamb of the doorframe in the first orientation, wherein one of the distal end of the first sidewall, the distal end of the second sidewall and the front side of the third sidewall contacts a frame stop of the door frame in the first orientation, wherein one of the front side of the first sidewall and the front side of the second sidewall contacts a ground section beneath the door in a second orientation, and wherein the front side of the third sidewall contacts a bottom rail of the door in the second orientation.

13. The wedge of claim 12, wherein at least one of the first sidewall and the second sidewall further comprise a first section and a stepped section, wherein the stepped section comprises a step length between a step distal end and a ledge, wherein the step distal end is positioned at the distal end of one of the first sidewall and the second sidewall, wherein the step length is less than one fourth of the sidewall length, wherein the first section extends from the proximal end of one of the first sidewall and the second sidewall to the ledge, wherein the first section contacts the jamb in the first orientation, and the ledge of the stepped section contacts the frame stop of the doorframe in the first orientation.

14. The wedge of claim 12, wherein the rigid core further comprises a hinge pin cutout positioned between the adjacent proximal ends of the first sidewall and the second sidewall, wherein the hinge pin cutout comprises a radius, and wherein the hinge pin cutout is situated around an axis extending through a hinge pin in a hinge pivotally connecting the doorframe and the door in the first orientation.

15. The wedge of claim 12, wherein the first sidewall, the second sidewall and the third sidewall respectively comprise a first sidewall thickness, a second sidewall thickness and a third sidewall thickness between the first face and the second face, and wherein the first thickness and the second thickness are approximately equal, and wherein the third sidewall thickness is no greater than the first thickness and the second thickness.

16. The wedge of claim 15, wherein the third sidewall further comprises one of a convex shape and a concave shape, wherein each of the convex shape and the concave shape comprise an arc length between the pair of ends of the third sidewall, and wherein the first thickness, the second thickness and the third thickness are less than one fourth the sidewall length and the arc length.

17. The wedge of claim 15, wherein the third sidewall thickness further comprises a first section thickness and a second section thickness, wherein the first section thickness is approximately equal to the first thickness and the second thickness, and wherein the second section thickness is less than half the first thickness, the second thickness and the first section thickness.

18. A wedge stop for a door in a doorframe, comprising:

a rigid core comprising a pair of faces, a first sidewall, a second sidewall, and a third sidewall, wherein the first sidewall, the second sidewall and the third sidewall each comprise a front side and a backside, wherein the first sidewall and the second sidewall each further comprise a proximal end and a distal end, wherein the distal end is separated from the proximal end by a sidewall length, wherein the proximal end of the first sidewall is adjacent to the proximal end of the second sidewall and is positioned at an angle relative thereto, wherein the third sidewall further comprises a pair of ends respectively connected the distal end of the first sidewall and the distal end of the second sidewall, and wherein the third sidewall is opposite from the angle;

a stepped section positioned on the front side of at least one of the first sidewall and the second sidewall, wherein the stepped section comprises a step length between a step distal end and a ledge, wherein the step distal end is positioned at the distal end of at least one of the first sidewall and the second sidewall, wherein the step length is less than one fourth the sidewall length, wherein one of the front side of the third sidewall and the ledge of the stepped section contacts a frame stop of the doorframe in a first orientation, wherein the other of the front side of the first sidewall and the front side of the second sidewall contacts an edge stile of the door in the first orientation, wherein one of the front side of the first sidewall and the front side of the second sidewall contacts a ground section beneath the door in a second orientation, and wherein the front side of the third sidewall contacts a bottom rail of the door in the second orientation;

a hinge pin cutout positioned between the adjacent proximal ends of the first sidewall and the second sidewall, wherein the hinge pin cutout comprises a radius, and wherein the hinge pin cutout is situated around an axis extending through a hinge pin in a hinge pivotally connecting the doorframe and the door in the first orientation; and a compressible outer layer attached to the first sidewall, the second sidewall, and the third sidewall, wherein the compressible outer layer is more flexible than the rigid core, and wherein the compressible outer layer covers the front side of the first sidewall, the front side of the second sidewall, the stepped section, the hinge pin cutout, and at least a portion of the front side of the third sidewall.

19. The wedge of claim 18, wherein at least one of the first sidewall and the second sidewall further comprise a first section extending between the proximal end and the ledge, and wherein the first section contacts the jamb in the first orientation.

20. The wedge of claim 18, wherein the first sidewall, the second sidewall and the third sidewall respectively comprise a first sidewall thickness, a second sidewall thickness and a third sidewall thickness between the first face and the second face, wherein the first thickness and the second thickness are approximately equal, wherein the third sidewall further comprises a concave shape, wherein the concave shape comprises an arc length between the pair of ends of the third sidewall, wherein the first thickness, the second thickness and the third thickness are less than one fourth the sidewall length and the arc length, wherein the third sidewall thickness further comprises a first section thickness and a second section thickness, wherein the first section thickness is approximately equal to the first thickness and the second thickness, and wherein the second section thickness is less than half the first thickness, the second thickness and the first section thickness.

* * * * *